US007911441B2

(12) United States Patent
Chao et al.

(10) Patent No.: US 7,911,441 B2
(45) Date of Patent: Mar. 22, 2011

(54) CURRENT-CONTROLLING APPARATUS FOR CONTROLLING CURRENT OF LIGHT EMITTING DIODE STRING

(75) Inventors: Han-Yu Chao, Tainan County (TW); Bi-Hsien Chen, Pingtung County (TW); Shin-Chang Lin, Taipei County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 1121 days.

(21) Appl. No.: 11/615,997

(22) Filed: Dec. 25, 2006

(65) Prior Publication Data

US 2008/0150877 A1 Jun. 26, 2008

(51) Int. Cl.
*G09G 3/36* (2006.01)

(52) U.S. Cl. ..... 345/102

(58) Field of Classification Search ..... 345/82–84, 345/102

See application file for complete search history.

(56) References Cited

U.S. PATENT DOCUMENTS 5,701,133 A 12/1997 Miller et al.
6,556,067 B2 4/2003 Henry
6,636,104 B2 10/2003 Henry
2003/0169097 A1 9/2003 Henry
2005/0073489 A1 4/2005 Suzunaga et al.
2005/0152123 A1 7/2005 Voreis et al.
2005/0243041 A1 11/2005 Vinn
2006/0186827 A1* 8/2006 Ragonesi et al. ..... 315/185 S
2006/0290625 A1* 12/2006 Sugimoto ..... 345/83
2007/0013321 A1* 1/2007 Ito et al. ..... 315/247

* cited by examiner

*Primary Examiner* — Chanh Nguyen
*Assistant Examiner* — Long Pham
(74) *Attorney, Agent, or Firm* — Jianq Chyun IP Office

(57) ABSTRACT

A current-controlling apparatus is suitable for controlling the current passing through a light emitting device string (LEDS), wherein an end of the LEDS is electrically connected to a first-voltage level. The current-controlling apparatus includes a current-adjusting unit and a control unit. The current-adjusting unit, electrically connected between a second-voltage level and another end of the LEDS, is used for detecting a current of the LEDS, producing a feedback signal hereby and controlling the impedance between the LEDS and the second voltage level according to a conductance-controlling signal and an impedance-controlling signal to control the current. The control unit is electrically connected to the current-adjusting unit for receiving a reference signal and the feedback signal, comparing the feedback signal with the reference signal to give a comparison result, performing a current compensation on the comparison result and converting the compensated comparison result into the conductance-controlling signal and the impedance-controlling signal.

12 Claims, 4 Drawing Sheets

CURRENT-CONTROLLING APPARATUS FOR CONTROLLING CURRENT OF LIGHT EMITTING DIODE STRING

BACKGROUND OF THE INVENTION

1. Field of Invention

The present invention relates to a current-controlling apparatus, and more particularly, to a current-controlling apparatus using a feedback control to adjust the current passing through a light emitting diode string (LED string) for adjusting the brightness of the LED string.

2. Description of the Related Art

For a backlight source implemented in LED mode of a liquid crystal display television (LCD television), a large number of LEDs are employed to make the backlight source match a cold cathode fluorescent lamp (CCFL) in terms of the brightness thereof. In order to reduce the number of the driving integrated circuits (driving IC) for the LEDs and lower the total driving current of the LEDs, the circuit of the backlight source is usually designed by employing multiple LEDs in series connection for lightening the same. Such a design not only reduces the set number of the driving ICs, but also lowers the total driving current of the LEDs and further lowers the consumption power of the driving ICs.

However, it is difficult to make the cut-in voltage (standing for the lowest voltage to turn on an LED) of every LED completely consistent with each other in an LED manufacturing process. Consequently, the error values for the cut-in voltage of every LED would be accumulated, which results in difference between the currents of each LED string set due to the inconsistent cut-in voltages under a constant input voltage. As a result, each of the individual LED string sets will have a different brightness. Therefore, a phenomenon of uneven brightness or uneven chrominance appears on the backlight source of a display panel.

To solve the above-mentioned problem, some of improvement schemes by using current mirrors were provided. In the U.S. Pat. No. 5,701,133, for example, a scheme is given by FIG. 1. FIG. 1 is a conventional brightness-adjusting circuit. Referring to FIG. 1, the symbol VLED represents a power voltage, GND represents a grounding voltage and Vin represents an input signal. The circuit shown by FIG. 1 is two current mirrors in series connection (102 and 103 in FIG. 1) formed by bipolar junction transistors (BJTs, for example, 101 in FIG. 1), respectively. Wherein, the current amount of the LED string 104 is controlled by taking the advantage that the current Im1 of the current mirror 102, the current Im2 of the current mirror 103 and the current Ic are equal to each other. In this way, the currents of every LED string set in a circuit with multiple sets of LED strings are controlled to be consistent with each other, thus the desired even brightness is achieved.

Note that the above-described circuit is a control system with an open loop by nature. Therefore, once an LED string in the system is malfunctioned (for example, some of LEDs in an LED string are short circuited), or an LED string has an excessive error of the total cut-in voltage (for example, the temperature characteristic of each LED slightly different from each other results in a larger error of the total cut-in voltage), the malfunction can not be detected due to lack of a feedback control mechanism. The BJTs of the current mirror may receive a great amount of voltage and currents, resulting in an overheat risk due to a constantly rising temperature thereof. Therefore, the reliability of products based on the above-described scheme is questionable.

Similarly, the U.S. Pat. No. 6,556,067 and No. 6,636,104 also employ current mirrors characterizing the same open loop control mode to make the currents of all LED string sets consistent with each other to achieve the brightness evenness. Thus, the reliability of such products is also in doubt.

SUMMARY OF THE INVENTION

The objective of the present invention is to provide a current-controlling apparatus which uses feedback control to adjust the current passing through an LED string, thereby achieving the purpose of adjusting the brightness of an LED string with high reliability.

Based on the above-mentioned or other objectives, the present invention provides a current-controlling apparatus suitable for controlling the current passing through a light emitting device string (LEDS). Wherein, an end of the LEDS is electrically connected to a power voltage. The current-controlling apparatus includes a current-adjusting unit and a control unit. The current-adjusting unit is electrically connected between another end of the LEDS and a grounding voltage for detecting the current of the LEDS and producing a feedback signal accordingly. According to a conductance-controlling signal and an impedance-controlling signal, the current-adjusting unit also controls the impedance value between the LEDS and the grounding voltage and further controls the current of the LEDS. The control unit is electrically connected to the current-adjusting unit for receiving a reference signal and a feedback signal, followed by comparing the two received signals with each other to produce a comparison result. Afterwards, the control unit performs a current compensation on the comparison result and converts the compensated comparison result into the conductance-controlling signal and the impedance-controlling signal.

Based on the above-mentioned or other objectives, the present invention provides a current-controlling apparatus suitable for controlling the currents of multiple LEDSes. Wherein, each of an end of the above-mentioned multiple LEDSes is electrically connected to a power voltage. The current-controlling apparatus includes a current-adjusting unit set and a control unit. The current-adjusting unit set is electrically connected between another end of the above-mentioned multiple LEDSes and a grounding voltage for detecting the current of every the LEDS and producing multiple feedback signals accordingly. The current-adjusting unit set also receives multiple conductance-controlling signals and multiple impedance-controlling signals and controls the impedance value between one of the above-mentioned LEDSes and the grounding voltage according to one of the above-mentioned conductance-controlling signal and one of the above-mentioned impedance-controlling signal, and further controls the current passing though the LEDS.

The control unit is electrically connected to the current-adjusting unit set for receiving a reference signal and the above-mentioned multiple feedback signals, followed by comparing every feedback signal with the reference signal to produce multiple comparison results. Afterwards, the control unit performs a current compensation on every comparison result and converts the compensated comparison results into the above-mentioned multiple conductance-controlling signals and the multiple impedance-controlling signals.

According to an embodiment of the present invention, the above-mentioned control unit includes an error amplifier, a current compensator, an impedance controller and a driving buffer. Wherein, the error amplifier is electrically connected to the current-adjusting unit for receiving a reference signal and a feedback signal and comparing the received signals with each other to produce a comparison result accordingly. The current compensator is electrically connected to the error amplifier for receiving the comparison result, performing a current compensation on the comparison result and outputting the compensated comparison result. The impedance controller is electrically connected to the current compensator for receiving the output from the current compensator and converting the output from the current compensator into a conductance-controlling signal and an impedance-controlling signal. The driving buffer is electrically connected to the impedance controller for receiving the conductance-controlling signal, buffering the conductance-controlling signal and outputting the buffered conductance-controlling signal.

According to an embodiment of the present invention, the above-mentioned current-adjusting unit includes a metal-oxide semiconductor transistor (MOS transistor), a variable impedance device, a feedback unit, a first resistor, a first capacitor, a second capacitor and a diode. Wherein, a source/drain of the MOS transistor is electrically connected to another end of the LEDS and the MOS transistor works in the linear zone thereof. The first resistor is electrically connected between another end of the LEDS and the first capacitor. The first capacitor is electrically connected between the first resistor and the gate of the MOS transistor. The second capacitor is electrically connected between the gate of the MOS transistor and the grounding voltage.

The variable impedance device is electrically connected between the control unit and the gate of the MOS transistor for delivering the conductance-controlling signal to the gate of the MOS transistor and dynamically adjusting the resistance of the variable impedance device according to the impedance-controlling signal, so as to make the MOS transistor shift the on/off status thereof according to the conductance-controlling signal and the resistance of the variable impedance device and further to adjust the impedance of the MOS transistor in on status. The anode of the diode is electrically connected to the gate of the MOS transistor, while the cathode thereof is electrically connected to the conductance-controlling signal. The feedback unit is electrically connected between another source/drain of the MOS transistor and the grounding voltage for detecting the current of the LEDS and producing a feedback signal accordingly.

According to an embodiment of the present invention, the above-mentioned control unit includes an error amplifier, a current compensator, an impedance controller and a driving buffer. Wherein, the error amplifier is electrically connected to the current-adjusting unit set for receiving the above-mentioned reference signal and the above-mentioned multiple feedback signals and comparing every feedback signal with the above-mentioned reference signal to produce the above-mentioned multiple comparison results. The current compensator is electrically connected to the error amplifier for receiving the above-mentioned multiple comparison results, performing a current compensation on every comparison result and respectively outputting the compensated comparison results. The impedance controller is electrically connected to the current compensator for receiving the outputs from the current compensator and converting the outputs from the current compensator into multiple conductance-controlling signals and multiple impedance-controlling signals. The driving buffer is electrically connected to the impedance controller for receiving the above-mentioned multiple conductance-controlling signals, buffering the conductance-controlling signals and respectively outputting the buffered conductance-controlling signals.

According to an embodiment of the present invention, the above-mentioned current-adjusting unit set includes multiple current-adjusting units and each current-adjusting unit includes a MOS transistor, a variable impedance device, a feedback unit, a first resistor, a first capacitor, a second capacitor and a diode. Wherein, a source/drain of the MOS transistor is electrically connected to another end of one of the above-mentioned multiple LEDSes and the MOS transistor works in the linear zone thereof. The first resistor is electrically connected between another end of the LEDS and the first capacitor. The first capacitor is electrically connected between the first resistor and the gate of the MOS transistor. The second capacitor is electrically connected between the gate of the MOS transistor and the grounding voltage.

The variable impedance device is electrically connected between the control unit and the gate of the MOS transistor for delivering one of the above-mentioned multiple conductance-controlling signals to the gate of the MOS transistor and dynamically adjusting the resistance of the variable impedance device according to one of the above-mentioned multiple impedance-controlling signals, so as to make the MOS transistor shift the on/off status thereof according to the conductance-controlling signal and the resistance of the variable impedance device and further to adjust the impedance of the MOS transistor in on status. The anode of the diode is electrically connected to the gate of the MOS transistor, while the cathode thereof is electrically connected to the conductance-controlling signal. The feedback unit is electrically connected between another source/drain of the MOS transistor and the grounding voltage for detecting the current of one of the LEDSes and producing one of the above-mentioned multiple feedback signals accordingly.

The present invention uses the current of the LEDS as a feedback control, performs a current compensation on the current of the LEDS and converts the compensated current into two signals to control the impedance of the MOS transistor in on status (i.e. to control the channel size of the MOS transistor in on status). In this way, i.e. adjusting the current passing through the LEDS by changing the impedance of the MOS transistor in on status, the goal of adjusting the brightness of the LEDS is achieved. Therefore, compared with the conventional brightness-adjusting circuit where current mirrors are used to realize an open loop control mode, the present invention has a better reliability.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve for explaining the principles of the invention.

DESCRIPTION OF THE EMBODIMENTS

Figure 1:
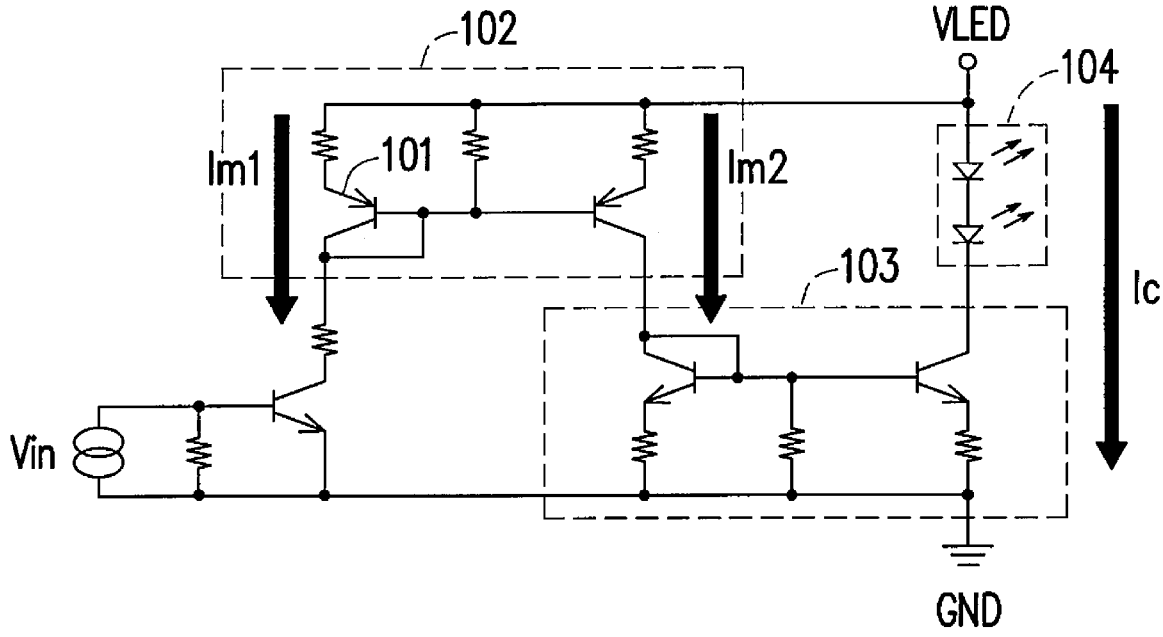
FIG. 1 (PRIOR ART)
FIG. 1 is a conventional brightness-adjusting circuit.
Figure 2:
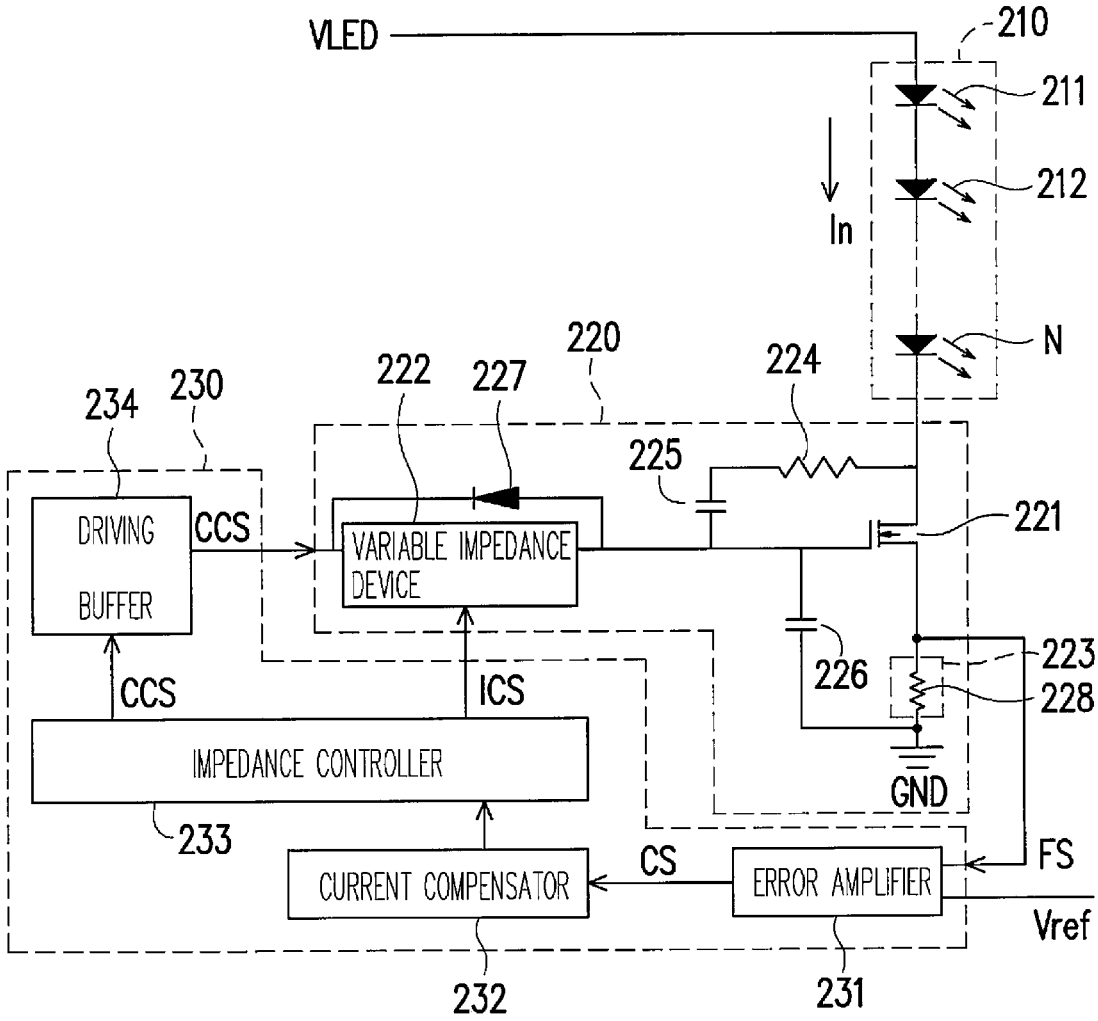
FIG. 2 is a current-controlling apparatus according to an embodiment of the present invention.

FIG. 2 is a current-controlling apparatus according to an embodiment of the present invention. Referring to FIG. 2, the current-controlling apparatus is suitable for controlling the current In passing through the LEDS 210. In the embodiment, the LEDS 210 is formed by LEDs 211, 212~N and an end of the LEDS 210 is electrically connected to a power voltage VLED (i.e. a first voltage level). The present invention, however, does not limit the LEDS 210 to be formed by LEDs only.

The current-controlling apparatus includes a current-adjusting unit 220 and a control unit 230. The current-adjusting unit 220 is used for detecting the current In of the LEDS 210, producing a feedback signal FS hereby and controlling the impedance between the LEDS 210 and the grounding voltage GND (i.e. the second voltage level) according to a conductance-controlling signal CCS and an impedance-controlling signal ICS, and further controlling the current In of the LEDS 210. The control unit 230 is used for receiving a reference signal Vref and a feedback signal FS, followed by comparing the two received signals with each other to produce a comparison result CS. Afterwards, the control unit 230 performs a current compensation on the comparison result CS and converts the compensated comparison result CS into the conductance-controlling signal CCS and the impedance-controlling signal ICS.

The control unit 230 includes an error amplifier 231, a current compensator 232, an impedance controller 233 and a driving buffer 234. Wherein, the error amplifier 231 is used for receiving the reference signal Vref and the feedback signal FS, comparing the feedback signal FS with the reference signal Vref to produce the comparison result CS. The current compensator 232 is used for receiving the comparison result CS output from the error amplifier 231, performing a current compensation on the comparison result CS and outputting the compensated comparison result. The impedance controller 233 is used for receiving the output from the current compensator 232 and converting the received output into the digitalized conductance-controlling signal CCS and impedance-controlling signal ICS. The driving buffer 234 is used for receiving the conductance-controlling signal CCS, buffering the received signal and outputting the buffered conductance-controlling signal CCS.

The above-mentioned driving buffer 234 is employed mainly for buffering and amplifying the conductance-controlling signal CCS output from the impedance controller 233. Thus, a user can decide whether or not to employ the driving buffer 234 in the control unit 230 according to the real need.

The current-adjusting unit 220 includes a MOS transistor 221, a variable impedance device 222, a feedback unit 223, a first resistor 224, a first capacitor 225, a second capacitor 226 and a diode 227. In the embodiment, the MOS transistor 221 is implemented by an NMOS transistor and assumed to be operated in the linear zone thereof. In addition, the feedback unit 223 is implemented by a second resistor 228, which detects the current from the MOS transistor 221 to the grounding voltage GND and converts the current into a voltage signal, i.e. the above-mentioned feedback signal FS.

The variable impedance device 222 delivers the conductance-controlling signal CCS output from the driving buffer 234 to the gate of the MOS transistor 221 and dynamically adjusts the resistance of the variable impedance device 222 according to the impedance-controlling signal ICS output from the impedance controller 233, so as to make the MOS transistor 221 shift on/off status in response to the conductance-controlling signal CCS and the resistance of the variable impedance device 222 and further to adjust the impedance of the MOS transistor 221 in on status, i.e. to adjust the channel size of the MOS transistor 221. In other words, the current In of the LEDS 210 is able to be controlled by adjusting the channel size of the MOS transistor 221, so that the brightness of the LEDS 210 is adjusted.

Figure 3:
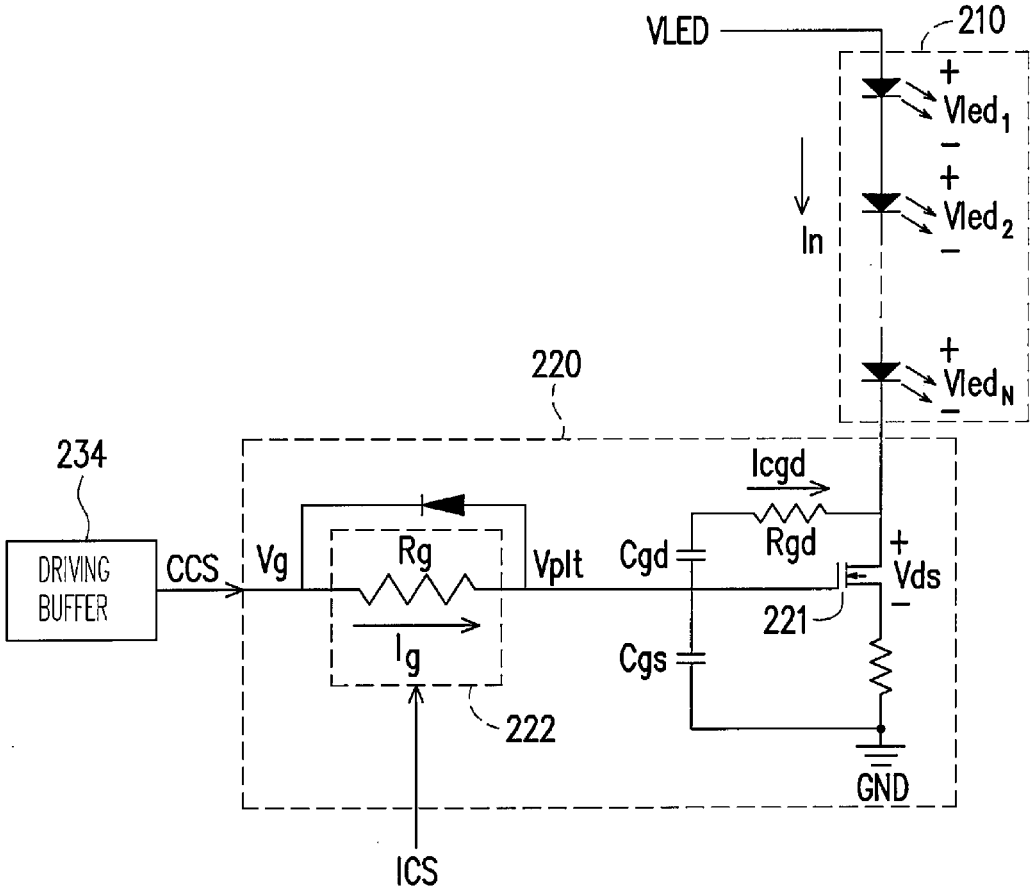
FIG. 3 is the schematic drawing of the partial circuit of FIG. 2.
Figure 4:
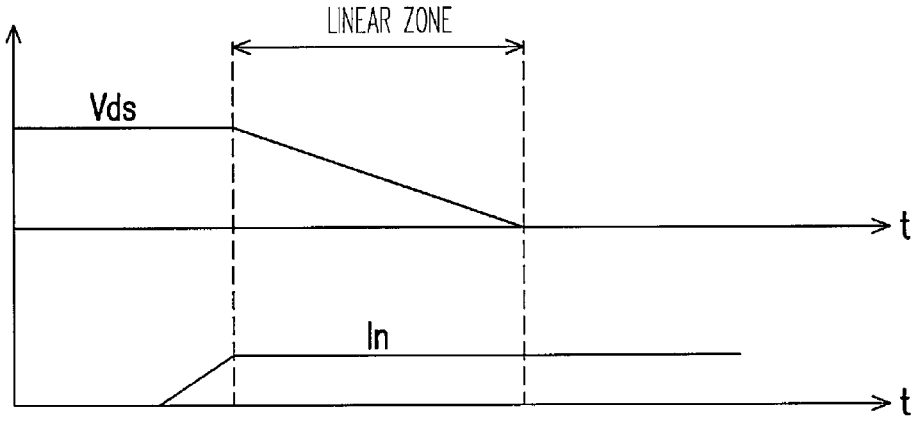
FIG. 4 is a characteristic chart of a MOS transistor.

FIG. 3 is the schematic drawing of the partial circuit of FIG. 2. FIG. 4 is a characteristic chart of a MOS transistor. In FIGS. 3 and 4, how the conductance-controlling signal CCS and the impedance-controlling signal ICS are used to control the current-adjusting unit 220 is illustrated. Referring to FIG. 3 first, Rg in the current-adjusting unit 220 represents the resistance of the variable impedance device 222, Ig represents the current passing through the variable impedance device 222, Vg represents the voltage at the electrical node between the variable impedance device 222 and the driving buffer 234, Vplt represents the voltage at the electrical node between the variable impedance device 222 and the MOS transistor 221, Cgd and Cgs respectively represent the capacitance of the first capacitor 225 and the capacitance of the second capacitor 226 in FIG. 2, Rgd represents the resistance of the first resistor 224 in FIG. 2, Icgd represents the current passing through the first resistor 224, Vds represents the voltage difference between the drain and the source of the MOS transistor 221 and Vled1, Vled2~VledN respectively represent the voltages of the LED 211, 212~N in FIG. 2. According to FIG. 3, there are the following six equations to depict the relationships among the above-mentioned parameters:

$$Ig \times Rg = Vg - Vplt \tag{1}$$

$$Icgd \cong Ig \tag{2}$$

$$Icgd = Cgd\frac{dVds}{dt} \tag{3}$$

$$\frac{dVds}{dt} = \frac{(Vg - Vplt)}{Rg \times Cgd} \tag{4}$$

$$\Delta Vds = \frac{(Vg - Vplt)}{Rg \times Cgd} \times \Delta t \tag{5}$$

$$VLED = (Vled1 + Vled2 + \ldots + Vled\,N) + Vds \tag{6}$$

From equation (5) it can be seen, ΔVds can be determined by the given Rg and Δt, where Δt represents a temperature variation and ΔVds represents the Vds variation corresponding to Δt. Referring to FIG. 4, after the MOS transistor falls in the linear zone, the voltage Vds varies linearly with the temperature, while the current In keeps constant. Referring to FIG. 3 again, during the MOS transistor 221 is working in the linear zone, the conductance-controlling signal CCS and the impedance-controlling signal ICS are used to respectively modulate the Δt parameter and the Rg parameter, so that the impedance of the MOS transistor 221 in on status is able to be varied. In other words, the voltage Vds is controlled by changing the channel size of the MOS transistor, and the obtained ΔVds is used to compensate the variation of the sum (Vled1+ Vled2+ . . . +VledN) caused by an accidental LED short circuit or the inconsistent temperature characteristics among the LEDs, so as to further control the current In of the LEDS 210.

Figure 5:
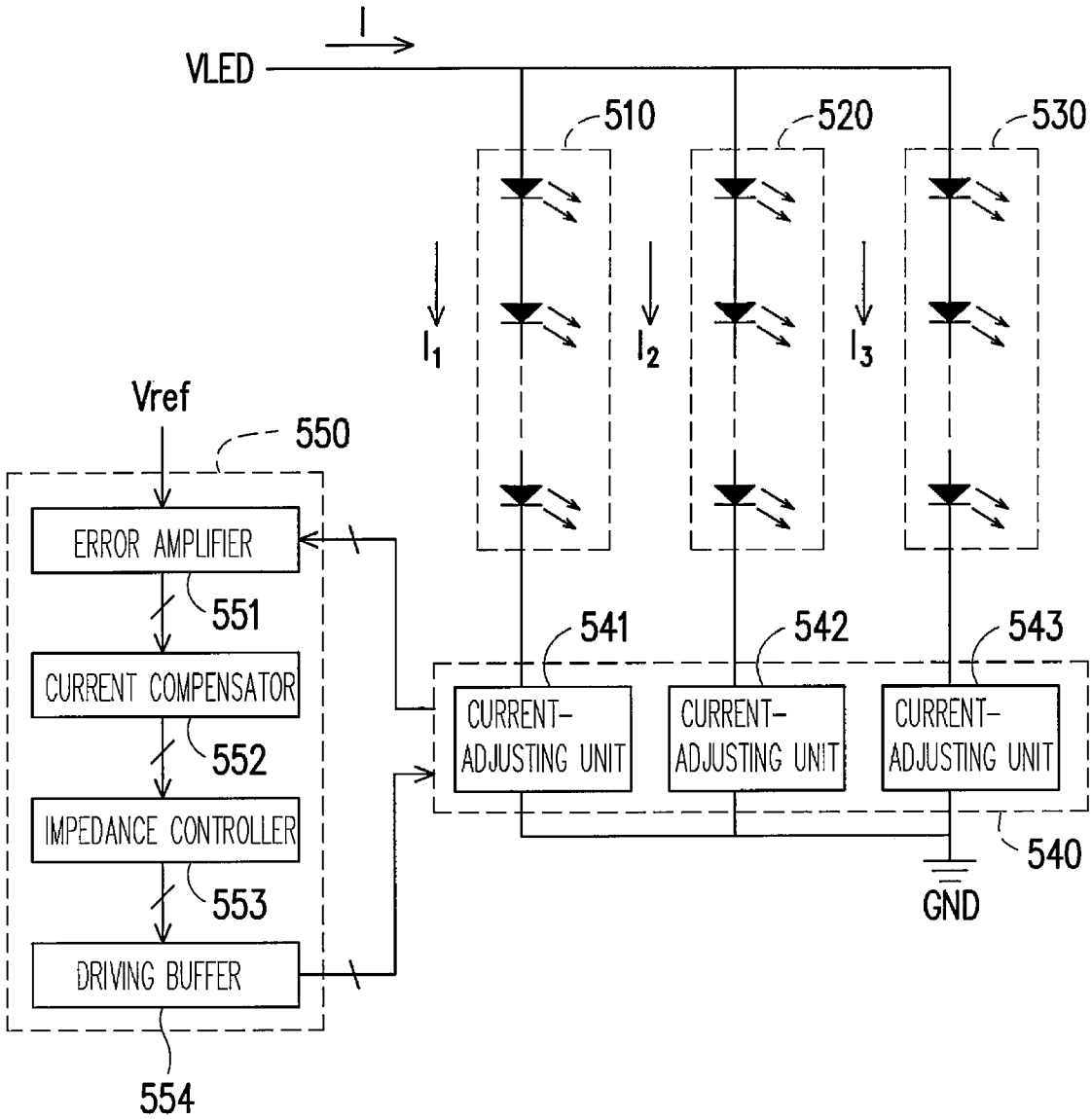
FIG. 5 is a current-controlling apparatus according to another embodiment of the present invention.

Anyone skilled in the art can further implement a control on the currents of multiple LEDSes according to the spirit of the present invention and the above-described instructions of the embodiment. FIG. 5 is one of the examples.

FIG. 5 is a current-controlling apparatus according to another embodiment of the present invention. Wherein, the current-controlling apparatus is suitable for controlling the currents $I_1$, $I_2$ and $I_3$ respectively passing through the LEDS 510, LEDS 520 and LEDS 530. The symbol I in FIG. 5 represents the current sum of $I_1$, $I_2$ and $I_3$. i.e. the total driving current of the LEDSes 510, 520 and 530. In the embodiment, all of the LEDSes 510, 520 and 530 are respectively formed by LEDs and an end of every of the LEDSes is electrically connected to the power voltage VLED (i.e. the first voltage level). However, the present invention does not limit the LEDSes 510, 520 and 530 to be formed by LEDs only.

The current-controlling apparatus includes a current-adjusting unit set 540 and a control unit 550. The current-adjusting unit set 540 is used for detecting the currents of the LEDSes 510, 520 and 530 and respectively producing feedback signals $FS_1$, $FS_2$ and $FS_3$ accordingly. The current-adjusting unit set 540 receives three conductance-controlling signals $CCS_1$, $CCS_2$ and $CCS_3$ and three impedance-controlling signals $ICS_1$, $ICS_2$ and $ICS_3$.

The current-adjusting unit set 540 controls the impedance between the LEDS 510 and the grounding voltage GND (i.e. the second voltage level) according to the conductance-controlling signal $CCS_1$ and the impedance-controlling signal $ICS_1$, controls the impedance between the LEDS 520 and the grounding voltage GND according to the conductance-controlling signal $CCS_2$ and the impedance-controlling signal $ICS_2$ and controls the impedance between the LEDS 530 and the grounding voltage GND according to the conductance-controlling signal $CCS_3$ and the impedance-controlling signal $ICS_3$. In this way, the current-adjusting unit set 540 is able to respectively control the currents passing through the LEDSes 510, 520 and 530.

The control unit 550 is used for receiving a reference signal Vref and feedback signals $FS_1$, $FS_2$ and $FS_3$, followed by comparing every received feedback signal with the reference signal to respectively produce comparison results $CS_1$, $CS_2$ and $CS_3$. Afterwards, the control unit 550 performs a current compensation on every the comparison result CS and respectively converts the compensated comparison results $CS_1$, $CS_2$ and $CS_3$ into the conductance-controlling signals $CCS_1$, $CCS_2$ and $CCS_3$ and the impedance-controlling signals $ICS_1$, $ICS_2$ and $ICS_3$.

The control unit 550 includes an error amplifier 551, a current compensator 552, an impedance controller 553 and a driving buffer 554. In the embodiment, each of the error amplifier 551, the current compensator 552, the impedance controller 553 and the driving buffer 554 has at least three input terminals and three output terminals for simultaneously processing at least three signals and respectively outputs the processed results. In particular, the error amplifier 551 requires at least four input terminals to receive an extra reference signal Vref in addition to the other three signals. However, it is noted that the present invention does not limit the numbers of the input terminals and the output terminals of the error amplifier 551, the current compensator 552, the impedance controller 553 and the driving buffer 554 to the above-mentioned numbers, and a user can choose the altered numbers to meet the real need.

The error amplifier 551 in the control unit 550 is used for receiving the reference signal Vref and the feedback signals $FS_1$, $FS_2$ and $FS_3$, comparing every feedback signal with the reference signal Vref to produce the above-mentioned comparison results $CS_1$, $CS_2$ and $CS_3$. The current compensator 552 is used for receiving the comparison results $CS_1$, $CS_2$ and $CS_3$ and, after performing a current compensation on every comparison result, respectively outputting the compensated comparison results. The impedance controller 553 is used for receiving the outputs from the current compensator 552 and respectively converting the received outputs into the conductance-controlling signals $CCS_1$, $CCS_2$ and $CCS_3$ and the impedance-controlling signals $ICS_1$, $ICS_2$ and $ICS_3$. The driving buffer 554 is used for receiving the conductance-controlling signals $CCS_1$, $CCS_2$ and $CCS_3$, buffering the received signals and outputting the buffered conductance-controlling signals.

Similar to the embodiment shown by FIG. 2, the above-mentioned driving buffer 554 is also used for taking the conductance-controlling signals $CCS_1$, $CCS_2$ and $CCS_3$ output from the impedance controller 553 to respectively buffer and amplify the signals. Therefore, a user can decide whether or not to employ the driving buffer 554 in the control unit 550 to meet the real need.

The above-described current-adjusting unit set 540 includes three current-adjusting units 541, 542 and 543. Every current-adjusting unit has the same design architecture as the current-adjusting unit 220 shown in FIG. 2 and the designs and the operations of the current-adjusting units 541, 542 and 543 are omitted to describe for simplicity herein.

The current-adjusting unit 541 is used for detecting the current $I_1$ of the LEDS 510, producing a feedback signal $FS_1$ hereby and receiving the conductance-controlling signal $CCS_1$ and the impedance-controlling signal $ICS_1$ output from the control unit 550 to adjust the impedance between the LEDS 510 and the grounding voltage GND. Similarly, the current-adjusting unit 542 is used for detecting the current $I_2$ of the LEDS 520, producing a feedback signal $FS_2$ hereby and receiving the conductance-controlling signal $CCS_2$ and the impedance-controlling signal $ICS_2$ output from the control unit 550 to adjust the impedance between the LEDS 520 and the grounding voltage GND. In addition, the current-adjusting unit 543 is used for detecting the current $I_3$ of the LEDS 530, producing a feedback signal $FS_3$ hereby and receiving the conductance-controlling signal $CCS_3$ and the impedance-controlling signal $ICS_3$ output from the control unit 550 to adjust the impedance between the LEDS 530 and the grounding voltage GND.

In this way, it is implemented to control the currents $I_1$, $I_2$ and $I_3$ of the LEDSes 510, 520 and 530 are respectively controlled to achieve the goal of adjusting the brightness of the above-mentioned LEDSes, so as to further make the brightness of the LEDSes 510, 520 and 530 even. However, the current-controlling apparatus is not limited to adjust the currents of the above-described three LEDSes only. In fact, anyone skilled in the art is able to determine a reasonable number of the current-adjusting units in a current-adjusting unit set 540 depending on the number of the LEDSes, and correspondingly adjust the numbers of the input terminals and the output terminals of the error amplifier 551, the current compensator 552, the impedance controller 553 and the driving buffer 554.

Note that although a feasible design mode of the circuit inside a current-adjusting unit is given by the above-described embodiments, it is well-known for anyone skilled in the art that each manufacturer has a different design of the current-adjusting unit. Therefore, the present invention does not limit any feasible design mode in a real application. In other words, any modified design of a current-adjusting unit is considered to be within the spirit of the invention if the current of an LEDS is regulated by adjusting the channel size of a transistor according to the input signal of the current-adjusting unit, where the transistor can be, for example, a MOS transistor, a BJT or an insulated gate bipolar transistor (IGBT), the channel size of the transistor is variable and the transistor works in the linear zone thereof.

In summary, the present invention uses the current of an LEDS to conduct a feedback control, performs a current compensation on the current of the LED string, and after the current compensation, converts the result into two signals which control the impedance of a MOS transistor in on status, so as to adjust the impedance of the MOS transistor in on status and thereby change the current passing through the LED string, thus achieving the goal of adjusting the LED brightness. Compared with the conventional brightness-adjusting circuit, where current mirrors are used to realize an open loop control mode, the present invention has a better reliability.

It will be apparent to those skilled in the art that various modifications and variations can be made to the structure of the present invention without departing from the scope or spirit of the invention. In view of the foregoing, it is intended that the specification and examples to be considered as exemplary only, with a true scope and spirit of the invention being indicated by the following claims and their equivalents.

What is claimed is:

1. A current-controlling apparatus, suitable for controlling the current of an LEDS (LED string), wherein an end of the LEDS is electrically connected to a first voltage level; the current-controlling apparatus comprising:

a current-adjusting unit, electrically connected between another end of the LEDS and a second voltage level, used for detecting the current of the LEDS, accordingly producing a feedback signal and controlling the impedance between the LEDS and the second voltage level according to a conductance-controlling signal and a impedance-controlling signal for further controlling the current of the LEDS, wherein the current-adjusting unit comprises:

a MOS transistor, wherein a source/drain of the MOS transistor is electrically connected to another end of the LEDS;

a variable impedance device, electrically connected between the control unit and the gate of the MOS transistor, used for delivering the conductance-controlling signal to the gate of the MOS transistor and dynamically adjusting the resistance of the variable impedance device according to the impedance-controlling signal, so that the MOS transistor is able to shift the on/off status thereof according to the conductance-controlling signal and the resistance of the variable impedance device, and the impedance of the MOS transistor in on status is further adjusted; and a feedback unit, electrically connected between another source/drain of the MOS transistor and the second voltage level, used for detecting the current of the LEDS and accordingly producing the feedback signal; and a control unit, electrically connected to the current-adjusting unit, used for receiving a reference signal and the feedback signal and comparing the feedback signal with the reference signal to produce a comparison result, performing a current compensation on the comparison result and converting the compensated comparison result into the conductance-controlling signal and the impedance-controlling signal.

2. The current-controlling apparatus as recited in claim 1, wherein the control unit comprises:

an error amplifier, electrically connected to the current-adjusting unit, used for receiving the reference signal and the feedback signal and comparing the feedback signal with the reference signal to produce the comparison result;

a current compensator, electrically connected to the error amplifier, used for receiving the comparison result, performing a current compensation on the comparison result and outputting the compensated comparison result; and an impedance controller, electrically connected to the current compensator, used for receiving the output of the current compensator and converting the received output into the conductance-controlling signal and the impedance-controlling signal.

3. The current-controlling apparatus as recited in claim 2, wherein the control unit further comprises:

a driving buffer, electrically connected to the impedance controller, used for receiving the conductance-controlling signal, buffering the received conductance-controlling signal and outputting the buffered signal.

4. The current-controlling apparatus as recited in claim 1, wherein the MOS transistor is an NMOS transistor and the NMOS transistor works in the linear zone thereof.

5. The current-controlling apparatus as recited in claim 4, wherein the current-adjusting unit further comprises:

a first resistor, electrically connected between another end of the LEDS and the gate of the MOS transistor.

6. The current-controlling apparatus as recited in claim 5, wherein the current-adjusting unit further comprises:

a first capacitor, electrically connected between the first resistor and the gate of the MOS transistor.

7. The current-controlling apparatus as recited in claim 6, wherein the current-adjusting unit further comprises:

a second capacitor, electrically connected between the gate of the MOS transistor and the second voltage level.

8. The current-controlling apparatus as recited in claim 7, wherein the feedback unit comprises a second resistor electrically connected between another source/drain of the MOS transistor and the second voltage level.

9. The current-controlling apparatus as recited in claim 8, wherein the first voltage level is a power voltage.

10. The current-controlling apparatus as recited in claim 9, wherein the second voltage level is a grounding voltage.

11. The current-controlling apparatus as recited in claim 1, wherein the current-adjusting unit further comprises:

a diode, wherein the anode thereof is electrically connected to the gate of the MOS transistor, while the cathode thereof is electrically connected to the conductance-controlling signal.

12. The current-controlling apparatus as recited in claim 1, wherein the LEDS is formed by multiple LEDs.

* * * * *